US006079496A

United States Patent [19]

Hirth

[11] Patent Number: 6,079,496

[45] Date of Patent: Jun. 27, 2000

[54] REDUCED-SHOCK LANDING COLLAR

[75] Inventor: David Eugene Hirth, Pasadena, Tex.

[73] Assignee: Baker Hughes Incorporated, Houston, Tex.

[21] Appl. No.: 08/984,958

[22] Filed: Dec. 4, 1997

[51] Int. Cl.[7] ..... E21B 34/14

[52] U.S. Cl. ..... 166/321; 166/332.1

[58] Field of Search ..... 166/317, 318, 166/319, 321, 324, 332.1, 328

[56] References Cited

U.S. PATENT DOCUMENTS

| | | | |
|---|---|---|---|
| 3,878,889 | 4/1975 | Seabourn | 166/0.5 |
| 4,081,032 | 3/1978 | Hutchinson et al. | 166/317 |
| 4,099,563 | 7/1978 | Hutchison et al. . | |
| 4,292,988 | 10/1981 | Montgomery | 137/68 R |
| 4,427,070 | 1/1984 | O'Brien | 166/317 |
| 4,674,569 | 6/1987 | Revils et al. | 166/154 |
| 4,693,314 | 9/1987 | Wesson et al. | 166/317 |
| 5,318,118 | 6/1994 | Duell | 166/202 |
| 5,411,095 | 5/1995 | Ehlinger et al. . | |
| 5,499,687 | 3/1996 | Lee | 166/318 X |
| 5,533,571 | 7/1996 | Surjaatmadja et al. | 166/222 |
| 5,782,304 | 7/1998 | Garica-Soule et al. | 166/356 |
| 5,819,853 | 10/1998 | Patel | 166/373 |

*Primary Examiner*—Frank Tsay
*Attorney, Agent, or Firm*—Duane, Morris & Heckscher LLP

[57] ABSTRACT

A landing collar is disclosed which defines a sealed cavity around its periphery. The landing collar has a seat to accept a sphere. Upon application of pressure on the sphere, the pressure rises on fluid in the chamber which surrounds the landing collar. At a predetermined pressure in the chamber, a rupture disc breaks which allows the fluid in the chamber to escape through a restrictor, thus regulating the rate of movement of the landing collar to expose gradually a bypass opening around the landing collar. Because the movement of the landing collar is regulated by the orifice adjacent the rupture disc, shock to the formation below is eliminated. In the event of sticking of the landing collar, an emergency release is possible since the landing collar is configured in two parts which can be pinned together. Upon an application of pressure higher than the pressure to break the rupture disc, the shear pins fail and a portion of the landing collar with the sphere disconnects to allow communication to the formation below.

20 Claims, 7 Drawing Sheets

REDUCED-SHOCK LANDING COLLAR

FIELD OF THE INVENTION

The field of this invention relates to devices useful for obstructing a tubing string to allow pressure build-up for hydraulically setting downhole tools where, subsequent to the hydraulic setting, a passage through the tubing can be reestablished.

BACKGROUND OF THE INVENTION

Liners are frequently attached to casing using hydraulically set slips and external casing packers. In order to actuate these hydraulically activated components, the liner string is provided with a landing collar which consists of a seat which accepts a sphere for obstruction of the central passage. Pressure is thereafter built up to actuate the hydraulic components to suspend the liner to the casing and/or to actuate packers. Typically, when the liner is secured, the passage must be reopened to allow cement to be pumped therethrough. At the conclusion of the cementing, the landing collar could be drilled out to reopen full-bore capabilities in the liner.

In situations where the formation is sensitive, the procedure for reestablishing flow in the liner created shocks of pressure into the formation. The reason this occurred is that the sphere landed on the seat would experience a pressure build-up beyond a predetermined value until a shear pin or pins would break. Generally, the ball and seat would move in tandem after the shear pin broke and such movement would instantaneously open a passage to the formation below. Thus, the built-up pressure behind the ball seated on the seat would very quickly create a pressure shockwave into the formation. The pressure to shear the pins was typically several thousand pounds per square inch. A large volume of fluid is generally present above the ball. This large volume contains a large amount of stored energy from the compressibility of the fluid itself and any dissolved gases that are in it. In addition, the applied pressure flexes the tubing above the ball which, upon relief of pressure, adds to the force behind the shockwave on the formation. The hydraulic shock to the formation is undesirable because it can cause damage to sensitive formations which can result in formation breakdown or severe fluid losses.

Prior designs which have retained the landing collar with shear screws have generally employed brass or bronze shear screws inserted into aluminum components. During applications involving elevated temperatures, such as above 350° F., the aluminum softens and the breakpoint of shear screws experiences a decline in reliability so that the breakpoint can be plus or minus 15% of the expected value. The use of harder metals in this type of a structure is undesirable because occasions can arise where the landing collar needs to be drilled out for subsequent downhole operations.

The tubular structure which comprises the seat has, in previous designs, been spring-loaded and secured to the housing in a pin-and-slot arrangement so that a succession of applications and removals of pressure could be used to advance the pin in the slot until eventually, the pin reached an open portion of the slot. When so aligned, the assembly of the seat and sphere would simply fall down the liner or be caught slightly below its initial position with only a minimal applied pressure. This type of structure was generally made of hard steels to facilitate its reliable operation. However, one of the problems that ensued with such a design, if it had to be drilled out, is that it took a long time to do that because of the hardness of the various components. This design could also jam due to the numerous movements required to release it.

Accordingly, what was needed and is necessarily an object of the present invention is a design which is simple and yet reliable. The objective of the present invention is to reduce, if not eliminate, shocks to the formation resulting from displacement of the ball-and-seat combination after the actuation of the hydraulic components downhole. Another objective accomplished by the simplicity of the design is to facilitate the use of softer materials, such as nonmetallic components so that subsequent drilling out, if necessary, can be accomplished quickly. Yet another objective is to provide greater reliability of actuation at a predetermined pressure level. This is in part accomplished by moving away from shear pin designs for normal operation to alternatives which have a demonstrated closer tolerance to actuation at a predetermined pressure. Those and other objectives will be more readily understood by a review of the preferred embodiment of the invention as described below.

SUMMARY OF THE INVENTION

A landing collar is disclosed which defines a sealed cavity around its periphery. The landing collar has a seat to accept a sphere. Upon application of pressure on the sphere, the pressure rises on fluid in the chamber which surrounds the landing collar. At a predetermined pressure in the chamber, a rupture disc breaks which allows the fluid in the chamber to escape through a restrictor, thus regulating the rate of movement of the landing collar to expose gradually a bypass opening around the landing collar. Because the movement of the landing collar is regulated by the orifice adjacent the rupture disc, shock to the formation below is eliminated. In the event of sticking of the landing collar, an emergency release is possible since the landing collar is configured in two parts which can be pinned together. Upon an application of pressure higher than the pressure to break the rupture disc, the shear pins fail and a portion of the landing collar with the sphere disconnects to allow communication to the formation below.

DETAILED DESCRIPTION OF THE PREFERRED EMBODIMENT

Figure 1:
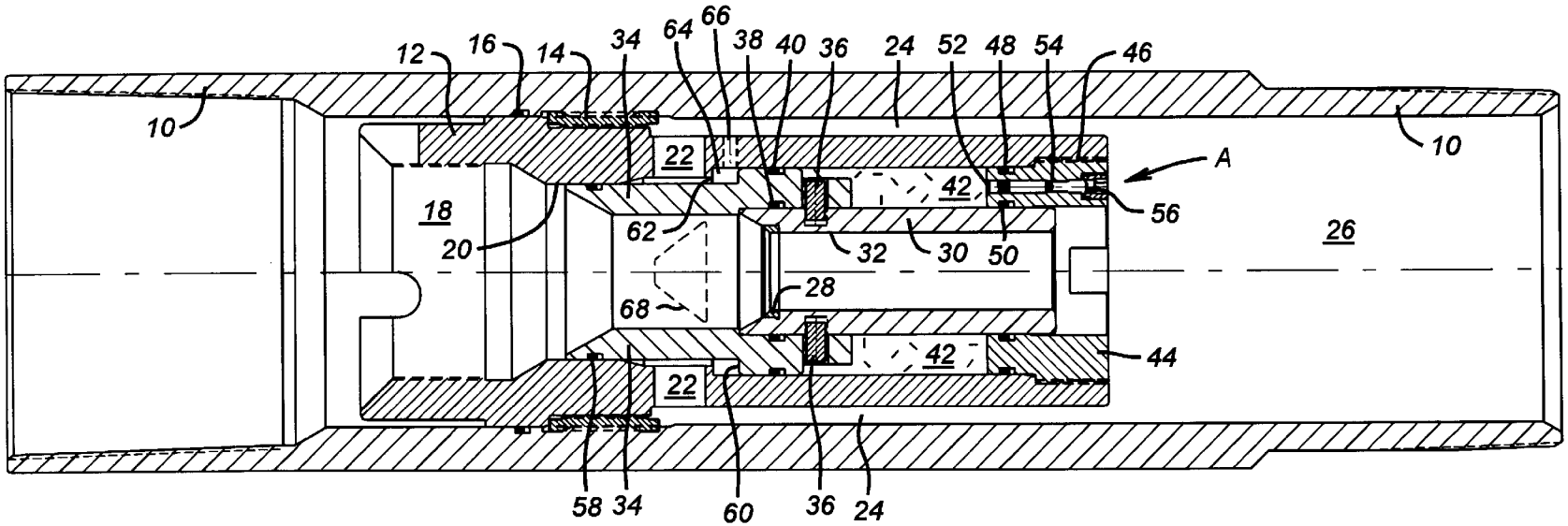
FIG. 1 is a sectional elevational view of the landing collar in the run-in position.

Referring to FIG. 1, the apparatus A is installed in a liner 10 by virtue of the engagement of housing 12 to the liner 10 by a threaded ring 14. Seal 16 seals between the liner 10 and the housing 12. Housing 12 has an inlet opening 18, a part of which is bore 20. Lateral port or ports 22 extend through housing 12 and ultimately communicate with annulus 24, which exists between the housing 12 and the passage 26 within the liner 10. The ball seat 28 is part of a sleeve 30. Sleeve 30 has a bore 32 extending therethrough. Sleeve 30 is secured to piston 34 by a pin or pins 36. Seal 38 seals between sleeve 30 and piston 34. Seal 40 seals between piston 34 and housing 12. Seals 38 and 40 are also upper seals on an annular chamber 42. A bottom sub 44 is secured to housing 12 at thread 46. Seal 48 seals between housing 12 and bottom sub 44. Seal 50 seals between sleeve 30 and bottom sub 44. Bottom sub 44 has a bore 52 within which are mounted a flow restrictor 54 and a rupture disc 56. Restrictor 54 can be an orifice. Rupture disc 56 can be any barrier that resists the applied force to permit the desired pressure build-up in the tubular before it releases. Other devices that allow pressure build-up to a particular point and then a release can be used without departing from the spirit of the invention. Depending on the system requirements, restrictor 54 or removable barrier 56 can be used individually without departing from the spirit of the invention.

Seal 58 seals between piston 34 and housing 12. Piston 34 has a shoulder 60 which is spaced from internal shoulder 62 on housing 12 to define an open chamber 64. Chamber 64 is in communication with annular space 24 through port or ports 66. Dashed line 68 illustrates the shape of openings 22 which are seen in section in FIG. 1.

Figure 2:
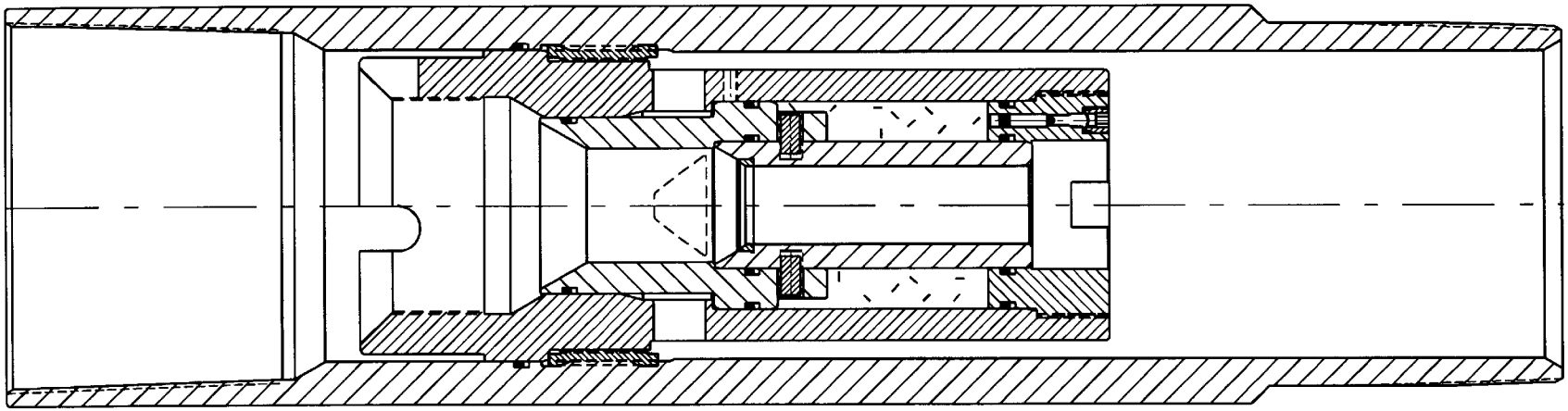
FIG. 2 illustrates the run-in position of FIG. 1, showing movement in response to thermal loads.

The apparatus A has the ability to respond to changes in thermal loading due to temperature change in fluids downhole which could expand the hydraulic fluid present in chamber 42, with rupture disc 56 intact. As seen by comparing FIGS. 1 and 2, an increase in temperature causes expansion of the fluid in chamber 42 and brings shoulder 60 closer to shoulder 62.

Figure 3:
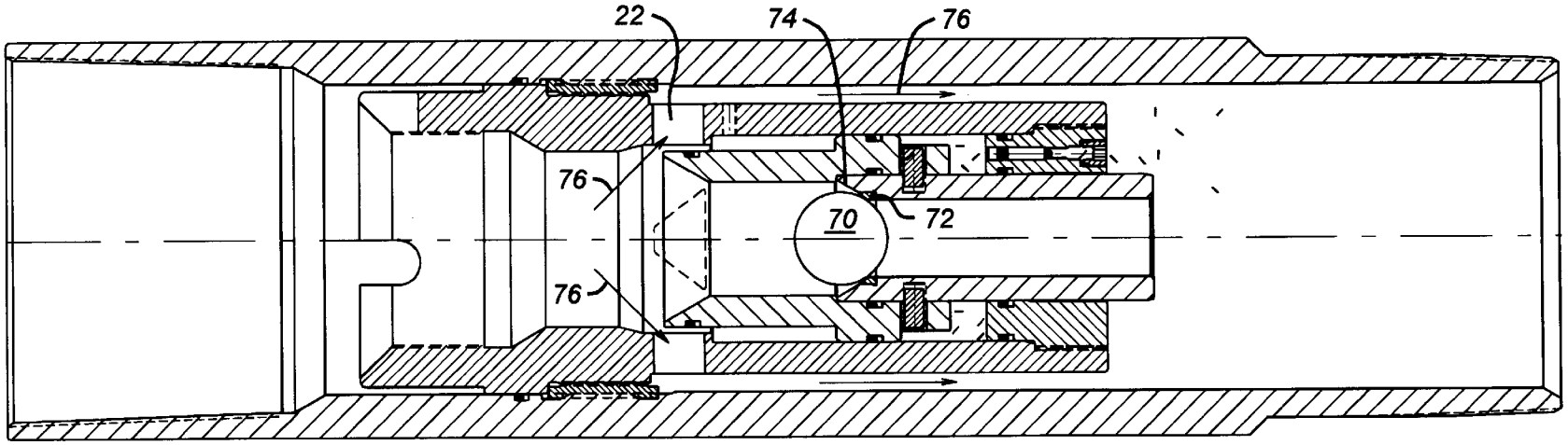
FIG. 3 is the view of FIG. 1, with the ball landed on the seat and the rupture disc broken to expose the bypass port.

Operation of the apparatus A involves dropping a ball 70, which is generally made of brass or bronze, although other materials can be used without departing from the spirit of the invention (see FIG. 3). The ball 70 lands on a ceramic insert 72, which forms a part of the ball-seat assembly 28 after passing through piston 34. Although a ceramic ring under pressure mounted adjacent the tapered surface 74 is the preferred way to create a seat for ball 70, other materials and configurations can be used without departing from the spirit of the invention. Until a certain pressure is developed on ball 70, sealingly engaged with ceramic insert 72, inlet 18 is sealingly isolated from annular space 24 by virtue of seal 58 (see FIG. 1). As pressure is built up on ball 70, piston 34, which is connected to sleeve 30 via shear pins 36, begins to exert pressure on the hydraulic fluid in chamber 42. At a predetermined pressure level of hydraulic fluid in chamber 42, the rupture disc 56 breaks. The hydraulic fluid can come out of chamber 42 through the orifice or restrictor 54. Movement of fluid out of chamber 42 allows piston 34 to advance in response to a force transmitted to it from applied pressure on ball 70 seated on ceramic insert 72, which is, in turn through the shear pin or pins 36, exerting a downward force on piston 34 through sleeve 30.

Upon movement of seal 58 beyond bore 20 and in alignment with taper 74, flow through ports 22 and into annular space 24 is established, as shown by arrow 76. Since the restrictor 54 controls the rate of movement of piston 34, and further in view of the cross-sectional trapezoidal shape illustrated for openings 22, the pressure above ball 70 is gradually relieved so as not to shock the formation below. As more and more longitudinal movement of piston 34 occurs, the cross-sectional area of openings 22, which are unobstructed, grows disproportionately bigger and bigger due to the trapezoidal cross-section of openings 22.

Figure 4:
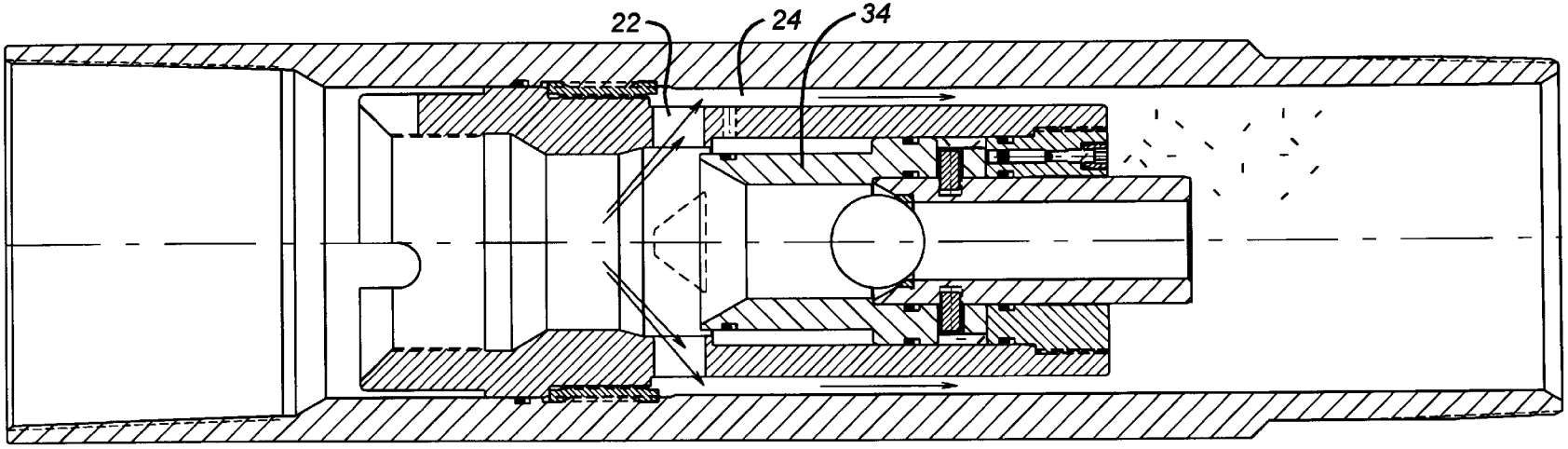
FIG. 4 is the view of FIG. 3 in the fully open position to allow subsequent downhole operations.

FIG. 4 illustrates the end position of piston 34, indicating that full flow has been achieved through the openings 22. Subsequent downhole operations, such as cementing, can now proceed as cement is pumped through the openings 22 and the annular passage 24. If necessary for further downhole operations, the entire assembly, including piston 34, housing 12, and sleeve 30, can be made of a nonmetallic material to facilitate rapid drilling out to provide full-bore access equal to the inside diameter of the liner.

Figure 5:
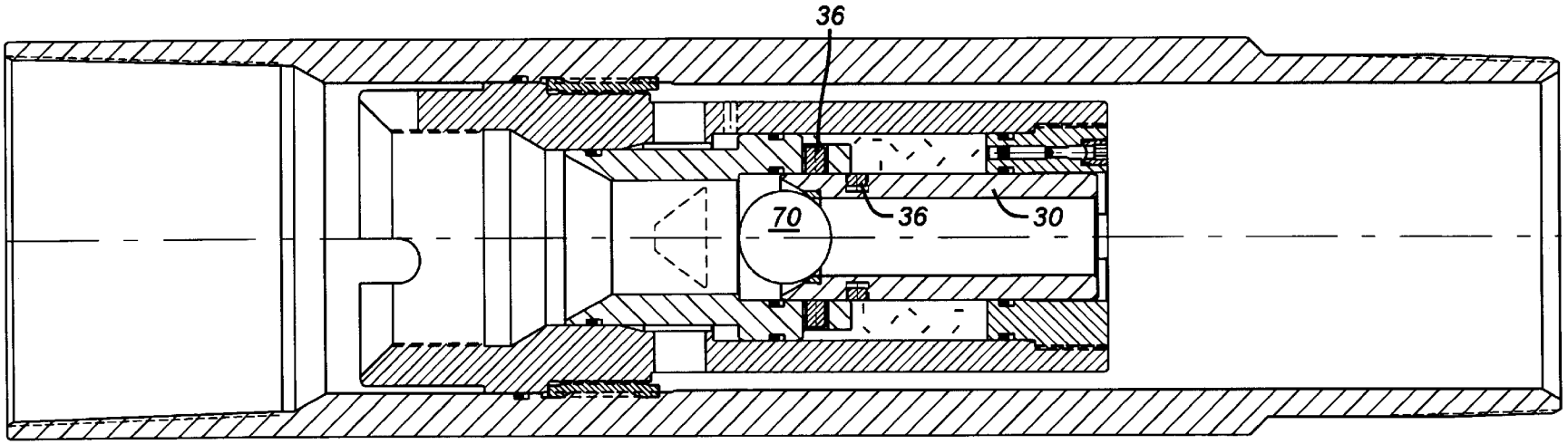
FIG. 5 illustrates the emergency release procedure when the landing collar assembly will not move to break the rupture disc, showing the ball landed in the seat and pressure build-up beginning.
Figure 6:
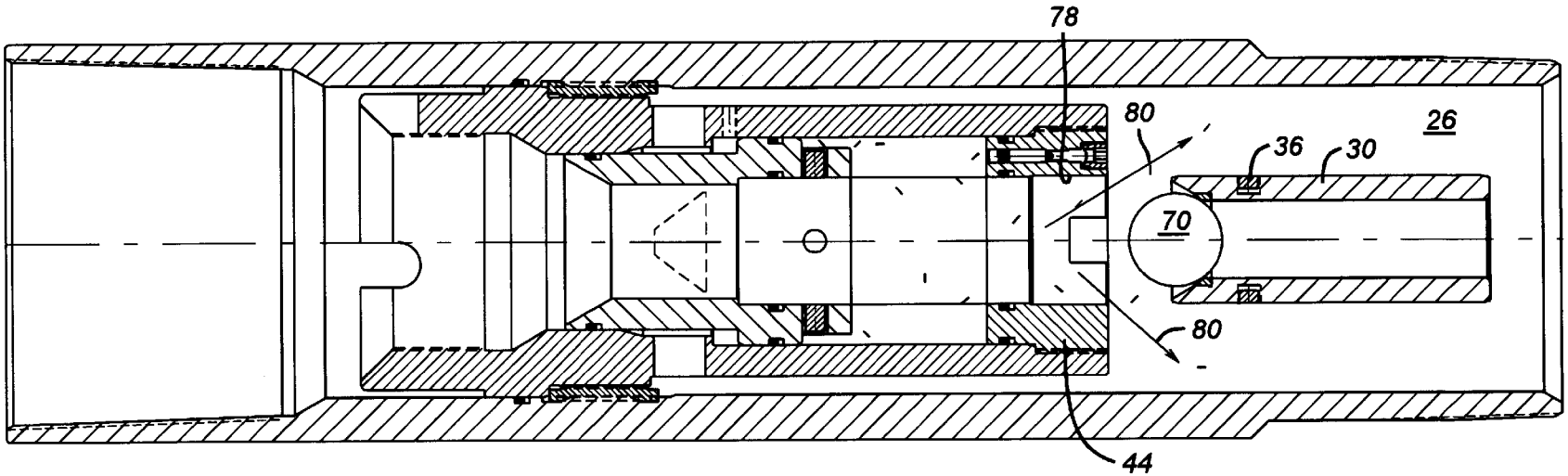
FIG. 6 is the view of FIG. 5, with sufficient pressure built up to break shear pins to allow the ball and seat to separate from the piston portion of the landing collar assembly.

FIGS. 5 and 6 illustrate the optional emergency release feature, which can be useful if, for any reason, the piston 34 refuses to move in response to applied pressure on ball 70. As previously stated, the pins 36 fasten the sleeve 30 to the piston 34. Upon a predetermined pressure higher than the pressure it would normally have taken to break the rupture disc 56, the pins 36 give out and fail in shear, as shown in FIG. 5. When that occurs, the sleeve 30 and the ball 70 together are pushed out of bottom sub 44 so that communication with passage 26 can be reestablished through bore 78 in bottom sub 44, as represented by arrows 80.

Figure 7:
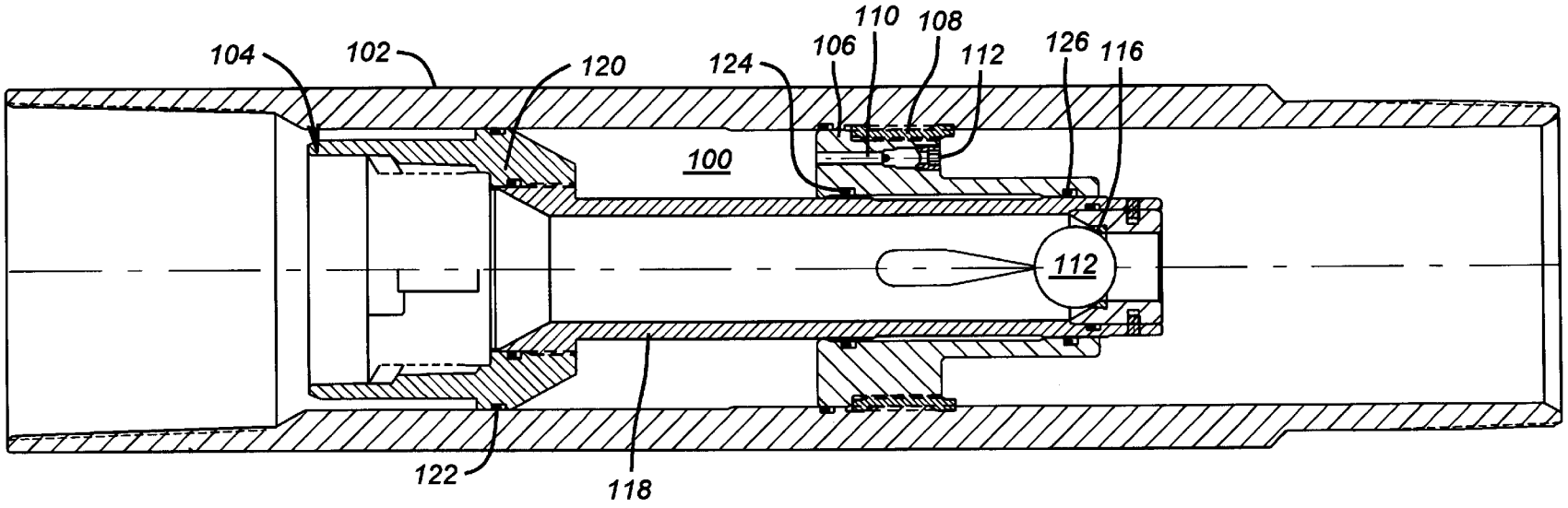
FIG. 7 is a sectional elevational view of an alternative embodiment which can be used in a nonmetal variant of the invention.

FIG. 7 illustrates an alternative embodiment which can be made of nonmetallic components. In the embodiment of FIG. 7, a cavity 100 is formed between the liner 102 and the piston assembly 104. Completing the description of the cavity 100, a ring 106 is secured to the liner 102 by a lock ring 108. A passage 110 goes through ring 106 and the rupture disk 112 covers the passage 110. The ball 114 lands on a seat 116 which can be integral or a separate component from the body 118, which forms a part of the piston assembly 104. In essence, the piston assembly 104 comprises a top ring 120, with a seal 122, a body 118, and a seat 116, which could be a separate structure as illustrated or an integral structure to the body 118. Seals 124 and 126 seal between the ring 106 and the body 118. In making a nonmetallic embodiment, the piston assembly 104, which includes top ring 120, body 118, and seat 116, can all be nonmetallic as well as the ring 106. Thus, in the embodiment of FIG. 7, the liner 102 serves as a portion of the chamber 100. Upon drillout, the entire assembly is easily removed, leaving the full inside diameter of the liner 102. The embodiment shown in FIG. 7, while preferably usable in a nonmetallic application, can also be constructed of other parts, such as metallic parts, without departing from the spirit of the invention.

As can be seen from the above description of the preferred embodiment, normal operation does not depend on shear failure of shear pins. Instead, the preferred embodiment utilizes a rupture disc which historically is more predictable, generally within ±5% of the predetermined rupture pressure required to break it. While the preferred embodiment is to combine a rupture disc 56 with an orifice 54, those skilled in the art will appreciate that the orifice 54 can be eliminated if there is no concern with shocking the formation below. The construction revealed in FIG. 7 and described above is simple and allows the use of nonmetallic parts to facilitate rapid drill-out if that is necessary for the particular application. Engineering-grade plastics, epoxies, or phenolics can all be used for these components as an alternative to soft metals, such as aluminum. The ball seat 72 is preferably made of a ceramic material, while the ball 70 can be brass or bronze or a phenolic-type of plastic or any other nonmetallic soft material. The shear pins 36 are preferably brass.

The trapezoidal cross-section of the openings 22 provides an ever-increasing open area of passages 22 for a given movement of the piston 34 so as to ease the relief of accumulated pressure above ball 70 when the rupture disc 56 is broken. The hydraulic fluid placed in the chamber 42 can be any type of clean, lightweight mineral oil. The pressure range required to break the rupture disc 56 can be selected for the particular design. It is preferred to have the burst pressure range for the rupture disc 56 at a level lower than the lowest anticipated pressure required to break the shear pins 36.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for selective pressure build-up in a tubular, comprising:

a seat assembly comprising a seat supported by a movable body, said seat adapted to receive a member thereon to obstruct the tubular for pressure build-up;

said seat assembly movable between a first position, where the tubular may be obstructed by said member, and a second position, where flow past said seat and member can occur; and a movement-regulating device operable on said seat assembly to selectively regulate the rate of movement from said first to said second position.

2. The apparatus of claim 1, wherein:

said regulating device prevents movement of said seat assembly until a predetermined range of applied pressure is exerted on said seat assembly.

3. The apparatus of claim 2, further comprising:

a housing defining a fluid chamber adjacent said seat assembly;

said seat assembly movably mounted to said housing such that movement of said seat assembly changes the volume of said fluid chamber.

4. The apparatus of claim 1, wherein:

at least one portion of said seat assembly is nonmetallic.

5. The apparatus of claim 4, wherein:

the entire seat assembly is nonmetallic.

6. An apparatus for selective pressure build-up in a tubular, comprising:

a seat assembly comprising a seat supported by a movable body, said seat adapted to receive a member thereon to obstruct the tubular for pressure build-up;

said seat assembly movable between a first position, where the tubular may be obstructed by said member, and a second position, where flow past said seat and member can occur; and a movement-regulating device operable on said seat assembly to selectively regulate movement from said first to said second position;

said regulating device prevents movement of said seat assembly until a predetermined range of applied pressure is exerted on said seat assembly;

said seat assembly is made of at least a first and second component;

said first component releasably engaged to said second component;

said first component interacting with said regulating device for control of movement of said seat assembly;

whereupon failure of said first component to move sufficiently toward said second position, a build-up of pressure on said seat, above said predetermined range, separates said first and second components to reestablish flow in the tubular.

7. An apparatus for selective pressure build-up in a tubular, comprising:

a seat assembly comprising a seat supported by a movable body, said seat adapted to receive a member thereon to obstruct the tubular for pressure build-up;

said seat assembly movable between a first position, where the tubular may be obstructed by said member, and a second position, where flow past said seat and member can occur; and a movement-regulating device operable on said seat assembly to selectively regulate movement from said first to said second position;

said regulating device prevents movement of said seat assembly until a predetermined range of applied pressure is exerted on said seat assembly;

a housing defining a fluid chamber adjacent said seat assembly;

said seat assembly movably mounted to said housing such that movement of said seat assembly changes the volume of said fluid chamber.

8. The apparatus of claim 7, wherein:

said removable barrier comprises a rupture disc.

9. The apparatus of claim 7, wherein:

said outlet comprises a flow restrictor to regulate fluid flow rate out of said fluid chamber to facilitate regulated movement of said seat assembly toward its said second position.

10. The apparatus of claim 9, wherein:

said housing comprises at least one lateral port and inlet;

said seat assembly mounted in said inlet and in its said first position blocking said port;

whereupon pressure build-up to said predetermined range, said seat assembly creates fluid pressure in said fluid chamber to remove said removable barrier so that said seat assembly can move toward its said second position;

whereupon said port is opened to reestablish flow in the tubular.

11. The apparatus of claim 10, wherein:

said port has a shape which creates an open area which increases disproportionately with increasing translational movement of said seat assembly.

12. The apparatus of claim 9, wherein:

said seat assembly is made of at least a first and second component;

said first component releasably engaged to said second component;

said first component forming a part of said fluid chamber;

whereupon failure of said first component to move sufficiently toward said second position to uncover said port, a build-up of pressure on said obstructed seat, above said predetermined range, separates said first and second components to reestablish flow in the tubular.

13. The apparatus of claim 12, wherein:

said seat is mounted on a sleeve which defines said second component;

said first component comprises a piston with respect to said cavity, having a bore therethrough to allow a member to pass therethrough and sealingly land on said seat;

said piston connected to said sleeve by a breakable member for tandem movement until an applied pressure beyond said predetermined range is applied to said sleeve;

whereupon failure of said piston to move toward said second position, said sleeve separates from said piston as said breakable member breaks.

14. The apparatus of claim 13, wherein:

said breakable member comprises at least one shear pin.

15. An apparatus for selective pressure build-up in a tubular, comprising:

a housing;

a seat assembly mounted to said housing and defining a fluid chamber, said fluid chamber having an outlet and an obstructing member in said outlet;

said seat assembly further comprising a seat which, when obstructed and subjected to a predetermined range of pressure within the tubular, causes said seat assembly to, in turn, increase fluid pressure in said chamber to overcome said obstructing member, which allows movement of said seat assembly at a controlled rate from a first position, where the tubular is obstructed, to a second position, where flow past said seat assembly is established.

16. The apparatus of claim 15, wherein:

said obstructing member further comprises a flow restriction member in said outlet.

17. An apparatus for selective pressure build-up in a tubular, comprising: a housing;

a seat assembly mounted to said housing and defining a fluid chamber, said fluid chamber having an outlet and an obstructing member in said outlet;

said seat assembly further comprising a seat which, when obstructed and subjected to a predetermined range of pressure within the tubular, causes said seat assembly to, in turn, increase fluid pressure in said chamber to overcome said obstructing member, which allows movement of said seat assembly from a first position, where the tubular is obstructed, to a second position, where flow past said seat assembly is established;

said obstructing member comprises a rupture disc.

18. An apparatus for selective pressure build-up in a tubular, comprising: a housing;

a seat assembly mounted to said housing and defining a fluid chamber, said fluid chamber having an outlet and an obstructing member in said outlet;

said seat assembly further comprising a seat which, when obstructed and subjected to a predetermined range of pressure within the tubular, causes said seat assembly to, in turn, increase fluid pressure in said chamber to overcome said obstructing member, which allows movement of said seat assembly from a first position, where the tubular is obstructed, to a second position, where flow past said seat assembly is established;

said seat assembly comprises a piston having a bore therethrough and a sleeve releasably secured to said piston;

said piston forming a portion of said chamber, said bore allowing an obstructing member to pass through said piston and sealingly engage said seat;

whereupon if said piston fails to move sufficiently toward its said second position, application of pressure beyond said predetermined range of pressure causes said sleeve with said seat obstructed to break away from said piston to allow flow through the tubular.

19. An apparatus for selective pressure build-up in a tubular, comprising: a housing;

a seat assembly mounted to said housing and defining a fluid chamber, said fluid chamber having an outlet and an obstructing member in said outlet;

said seat assembly further comprising a seat which, when obstructed and subjected to a predetermined range of pressure within the tubular, causes said seat assembly to, in turn, increase fluid pressure in said chamber to overcome said obstructing member, which allows movement of said seat assembly from a first position, where the tubular is obstructed, to a second position, where flow past said seat assembly is established;

said obstructing member further comprises a flow restriction member in said outlet;

said obstructing member comprises a rupture disc;

said seat assembly comprises a piston having a bore therethrough and a sleeve releasably secured to said piston;

said piston forming a portion of said chamber, said bore allowing an obstructing member to pass through said piston and sealingly engage said seat;

whereupon if said piston fails to move sufficiently toward its said second position, application of pressure beyond said predetermined range of pressure causes said sleeve with said seat obstructed to break away from said piston to allow flow through the tubular.

20. An apparatus for selective pressure build-up in a tubular, comprising:

a seat assembly comprising a seat supported by a movable body, said seat adapted to receive a member thereon to obstruct the tubular for pressure build-up;

said seat assembly movable between a first position, where the tubular may be obstructed by said member, and a second position, where flow past said seat and member can occur; and a movement-regulating device operable on said seat assembly to selectively regulate movement from said first to said second position;

the entire seat assembly is nonmetallic;

a substantial portion of said movement-regulating device is non-metallic.

* * * * *